US006797903B1

(12) United States Patent
Winslett et al.

(10) Patent No.: US 6,797,903 B1
(45) Date of Patent: Sep. 28, 2004

(54) EXTENDED ROTARY HANDLE OPERATOR

(75) Inventors: Michael Troy Winslett, Fairburn, GA (US); W. Dale Robbins, Snellville, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 10/776,142

(22) Filed: Feb. 11, 2004

(51) Int. Cl.[7] ..... H01H 9/28
(52) U.S. Cl. ..... 200/331; 200/50.11; 200/330
(58) Field of Search ..... 200/50.01, 50.11, 200/50.17, 50.19, 50.21, 50.23, 50.24, 50.25, 329–331; 361/605–610, 615

(56) References Cited

U.S. PATENT DOCUMENTS

| | | | | | |
|---|---|---|---|---|---|
| 3,980,845 | A | | 9/1976 | Gryctko et al. | 200/50 |
| 4,000,478 | A | | 12/1976 | Jencks et al. | 335/34 |
| 4,001,739 | A | | 1/1977 | Powell et al. | 335/34 |
| 4,001,742 | A | | 1/1977 | Jencks et al. | 335/173 |
| 4,612,424 | A | * | 9/1986 | Clark et al. | 200/50.18 |
| 5,219,070 | A | | 6/1993 | Grunert et al. | 200/330 |
| 5,286,935 | A | | 2/1994 | Mina et al. | 200/330 |
| 5,288,958 | A | * | 2/1994 | Grunert et al. | 200/331 |
| 5,302,925 | A | | 4/1994 | Castonguay et al. | 335/17 |
| 5,357,070 | A | | 10/1994 | Parsons | 200/331 |
| 5,362,933 | A | | 11/1994 | Kutsche et al. | 200/401 |
| 5,457,295 | A | | 10/1995 | Tanibe et al. | 200/293 |
| 5,475,190 | A | | 12/1995 | Smith et al. | 200/50 |
| 5,493,083 | A | | 2/1996 | Olivier | 200/17 |
| 5,493,084 | A | | 2/1996 | Whitaker et al. | 200/50 A |
| 5,902,973 | A | | 5/1999 | Ramey et al. | 200/50.01 |
| 5,998,750 | A | | 12/1999 | Wegener et al. | 200/564 |
| 6,075,215 | A | | 6/2000 | Bollinger, Jr. et al. | 200/317 |
| 6,194,983 | B1 | | 2/2001 | Bogdon et al. | 335/68 |
| 6,423,912 | B1 | * | 7/2002 | Arenz et al. | 200/43.08 |
| 6,518,526 | B2 | | 2/2003 | Hamada et al. | 200/330 |
| 6,596,952 | B1 | | 7/2003 | Degrazia et al. | 200/330 |
| 6,606,229 | B2 | | 8/2003 | Takahaski et al. | 361/115 |

* cited by examiner

*Primary Examiner*—Michael A. Friedhofer
(74) *Attorney, Agent, or Firm*—Foley & Lardner LLP

(57) ABSTRACT

A method and an extended rotary operating mechanism for a circuit breaker having a movable operating handle coupled to a shaft, and electrical contacts, the extended rotary operating mechanism comprising a handle operator defining a socket. A blocking plate mounted in the socket, with the blocking plate including a blocking shape. A shaft adapter is coupled to the blocking plate and the shaft. If the electrical contacts of the circuit breaker are welded closed and a torque is applied to the operator handle, the blocking shape prevents the handle operator from being locked in an "OFF" position independently of the operating handle position, by covering a locking hole. The shaft adapter may include one of an extended socket and a recessed socket configured to engage the shaft.

20 Claims, 5 Drawing Sheets

EXTENDED ROTARY HANDLE OPERATOR

BACKGROUND OF THE INVENTION

The present invention relates to circuit breakers, and more particularly to an extended rotary operating mechanism to operate a circuit breaker.

Circuit breakers, both single and multi-phase circuit breakers, are typically mounted in equipment cabinets. A typical electrical equipment cabinet includes a front closing door. In some instances, a handle of a circuit breaker protrudes through openings in the cabinet door and can be operated directly. In some applications it is desirable to provide an extended handle operating mechanism. The extended operating mechanism is coupled to the operating handle of the circuit breaker by a shaft.

In operation, the extended handle operating mechanism moves the circuit breaker operating handle to its various operative positions. For example, an "ON" position, and "OFF" position and "RESET" position. In some instances, it is necessary to lock the extended operating mechanism in an "OFF" position. However, in some instances, when the electrical contacts of the circuit breaker have become welded closed, usually as a result of a short circuit condition, locking the extended operating mechanism in an "OFF" position would create a dangerous and inappropriate condition since an operator would believe that the circuit breaker is in the "OFF" (electrical contacts open) condition, when in fact the electrical contacts are welded closed.

Thus there is a need for an extended rotary operating mechanism for a circuit breaker that will prevent the extended operating handle from being locked in an "OFF" position when the electrical contacts of the circuit breaker are in fact closed, such as in a welded closed condition.

SUMMARY OF THE INVENTION

There is provided an extended rotary operating mechanism for a circuit breaker having a movable operating handle coupled to a shaft and electrical contacts, the extended rotary operating mechanism comprising a handle operator defining a socket. A blocking plate mounted in the socket, with the blocking plate including a blocking shape. A shaft adapter is coupled to the blocking plate and the shaft. If the electrical contacts of the circuit breaker are welded closed and a torque is applied to the operator handle, the blocking shape prevents the handle operator from being locked in an "OFF" position independently of the operating handle position, by covering a locking hole. The shaft adapter may include one of an extended socket and a recessed socket configured to engage the shaft.

There is also provided a method for preventing an operating handle of the circuit breaker from being locked in an "OFF" position when electrical contacts of the circuit breaker are welded closed. The circuit breaker has a shaft coupled to the operating handle. The method comprises the steps of providing a handle operator having a socket and a mounting plate defining a locking hole providing a blocking plate having a blocking shape and configured to fit in the socket. A shaft adapter coupling the shaft adapter to the blocking plate and the shaft. Covering the locking hole with the blocking shape when a torque is applied to the handle operator.

There is further provided an extended rotary operating mechanism for a circuit breaker having a movable operating handle coupled to a shaft, and having electrical contacts. The extended rotary operating mechanism comprises a means for rotating defining a socket. A means for blocking mounted in the socket. A means for coupling operatively connected to the means for blocking and the shaft. Wherein, if the electrical contacts of the circuit breaker are welded closed and a torque is applied to the means for rotating, the means for blocking prevents the means for rotating from being locked in an "OFF" position, independently of the operating handle position, by covering a locking hole.

DETAILED DESCRIPTION OF EXEMPLARY EMBODIMENTS

Figure 1:
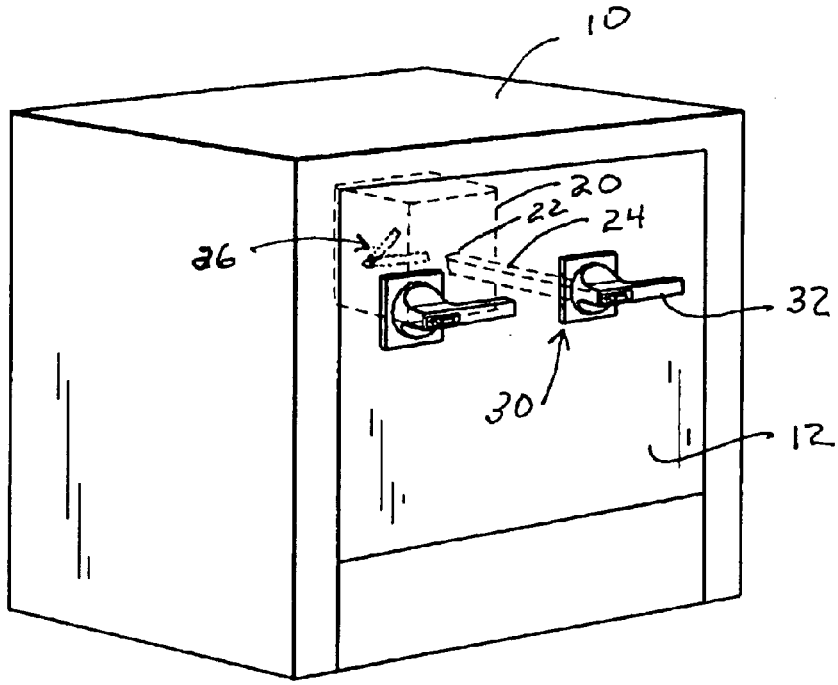
FIG. 1 is a perspective view of an electric equipment cabinet, enclosing a circuit breaker coupled to an exemplary embodiment of an extended rotary operating mechanism.

There is disclosed an extended rotary handle operating mechanism 30 having a locking feature that can only be actuated if the electrical 26 contacts of the circuit breaker 20 are open. If the electrical contacts 26 are welded closed, (e.g. due to short circuit) the extended rotary operating mechanism 30 will not be able to lock. This is commonly referred to as "Suitable for Isolation" or "Positive OFF".

If any electrical contact 26 of a circuit breaker 20 is welded, the locking portion of the extended rotary operating mechanism 30 will not be able to lock and when released the handle operator 32 of the extended rotary operating mechanism 30 will return to indicate the "ON" position. This is a feature that indicates to the user that the electrical contacts 26 are welded and prevent other users that may work on the equipment from falsely believing the electrical contacts 26 are open.

Prior art relied on the location of the circuit breaker handle to insure it would not lock during the Positive OFF. The disadvantage of such prior art is, with wear, the location of the handle operating mechanism approaches the locked position and relies on the force limits set by standard specifications in order to insure it cannot be locked. The present disclosure is independent of handle location and uses the torque applied to the handle operator 32 to prevent the device from locking. It will only lock if no excessive torque is applied to the handle operator 32.

Referring to the Figures, FIG. 1 illustrates an electrical cabinet 10 which encloses a circuit breaker 20. The circuit breaker 20 includes an operating handle 22 and electrical contacts 26. The operating handle 22 is coupled to a shaft 24 which is coupled to an extended rotary operating mechanism 30. As illustrated, the extended rotary operating mechanism 30 is mounted on the outside of the cabinet 10 on the cabinet door 12.

Figure 2:
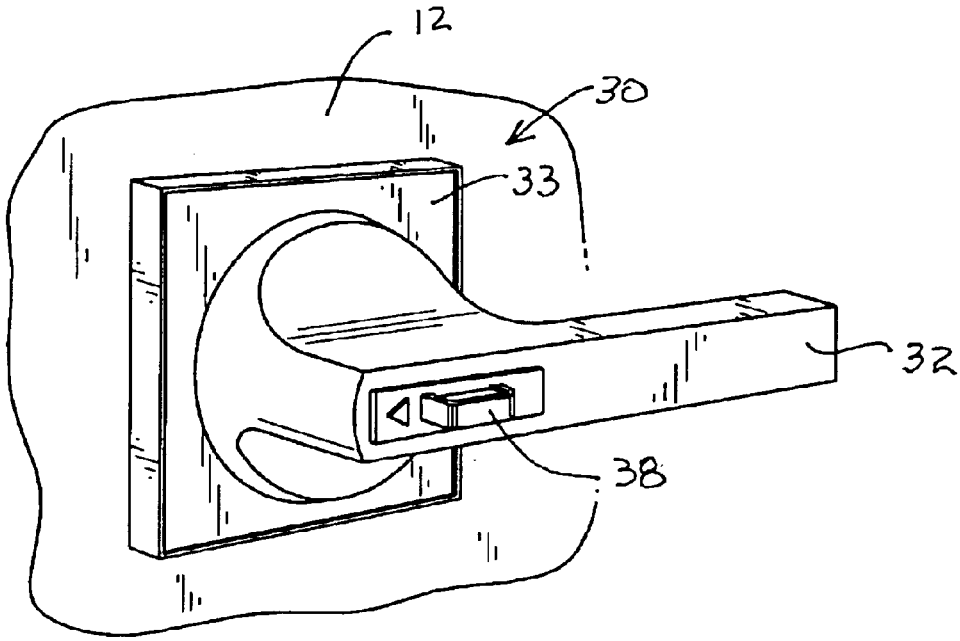
FIG. 2 is a perspective front side view of an exemplary embodiment of a handle operator of an extended rotary operating mechanism.

FIG. 2 illustrates the handle operator 32 of an exemplary embodiment of an extended rotary operating mechanism 30. The handle operator 32 is mounted on a mounting plate 33 which is coupled to the cabinet door 12. A locking pin actuator 38 is conveniently placed on the handle operator 32 and its function will be explained below. Indicia of the position of the circuit breaker contacts are typically placed on the cabinet door 12 to indicate the "OFF", "ON", "RESET" and "TRIPPED" positions of the circuit breaker.

Figure 3:
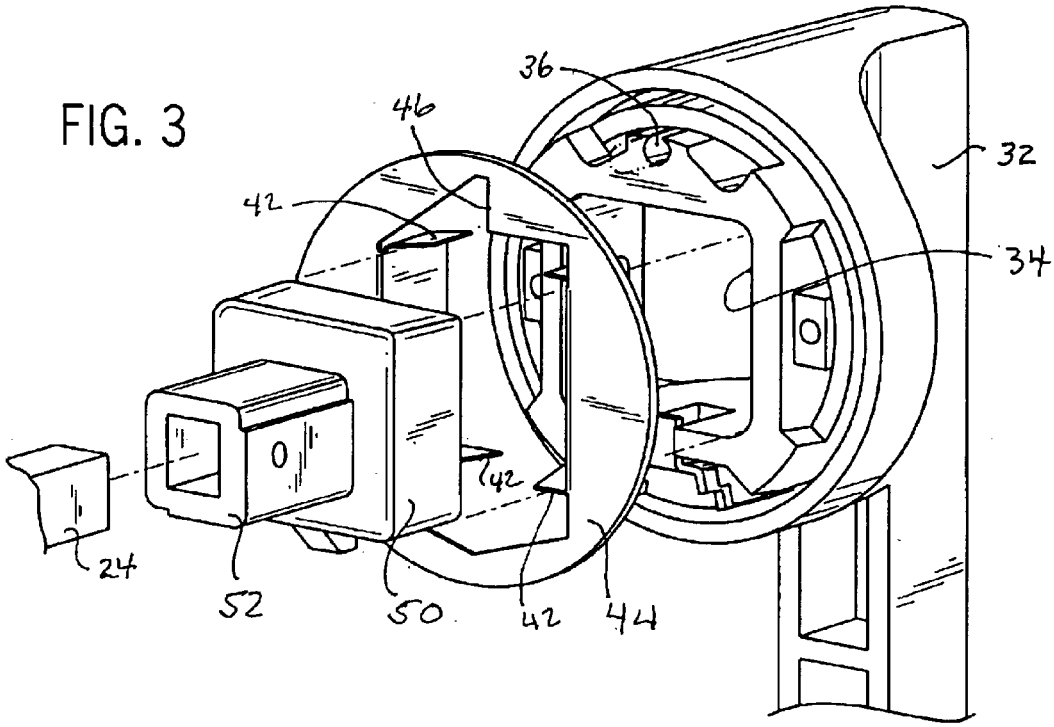
FIG. 3 is an exploded perspective view of an exemplary embodiment of an extended rotary handle mechanism.

The extended rotary operating mechanism 30 includes the handle operator 32. The handle operator 32 defines a socket 34 (see FIG. 3). The socket 34 is configured to receive a blocking plate 44. The blocking plate 44 is mounted in the socket 34 and includes a blocking shape 46. The blocking shape 46 can be any suitable shape consistent with the blocking shape 46 function of blocking the locking hole 26. One method of mounting the blocking plate 44 in the socket 34 is by shaped tabs 42 which extend into the socket 34.

The handle operator 32 can be composed of any suitable material such as plastic and can be molded or extruded by conventional methods. The blocking plate 44 can be composed of metal and formed by stamping or other suitable fabrication.

Figure 5:
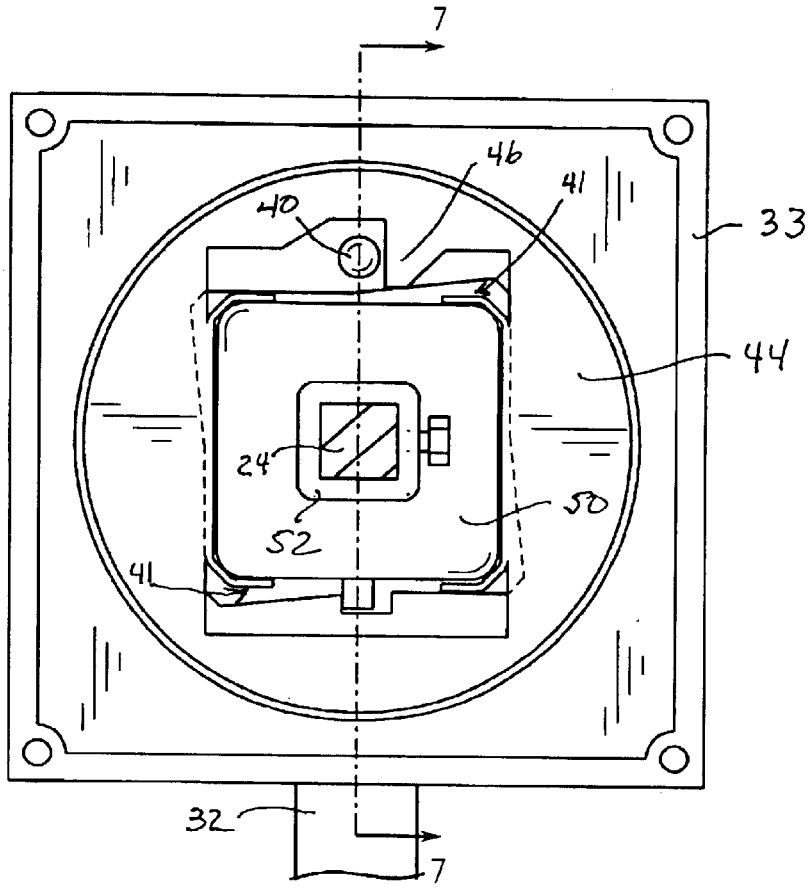
FIG. 5 is a plan back side view of an exemplary embodiment of an extended rotary handle mechanism in a lockable position.
Figure 6:
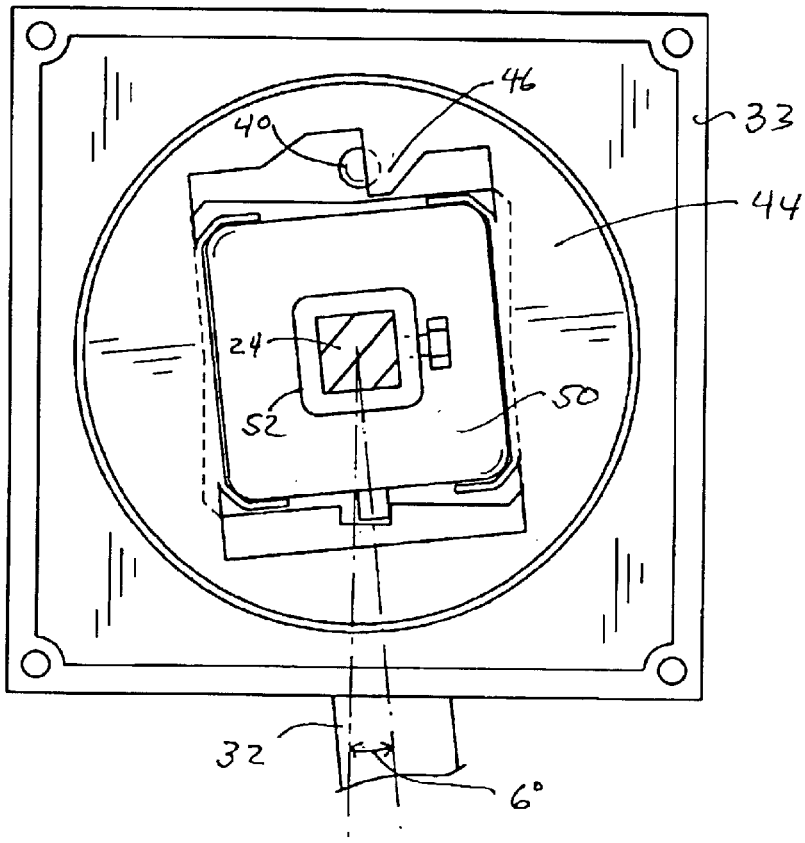
FIG. 6 is a plan back side view of an exemplary embodiment of an extended rotary handle mechanism in a blocking position.

The socket 34 of the handle operator 32 is configured so that the blocking plate 44 can rotate approximately 3° to 8° within the handle. FIG. 6 illustrates a rotation of about 6° before the blocking shape 46 blocks the locking hole 36. Gaps 41 (see FIG. 5) exist between the socket 34 and the blocking plate 44 when the handle operator 32 is in a lockable position.

Figure 4:
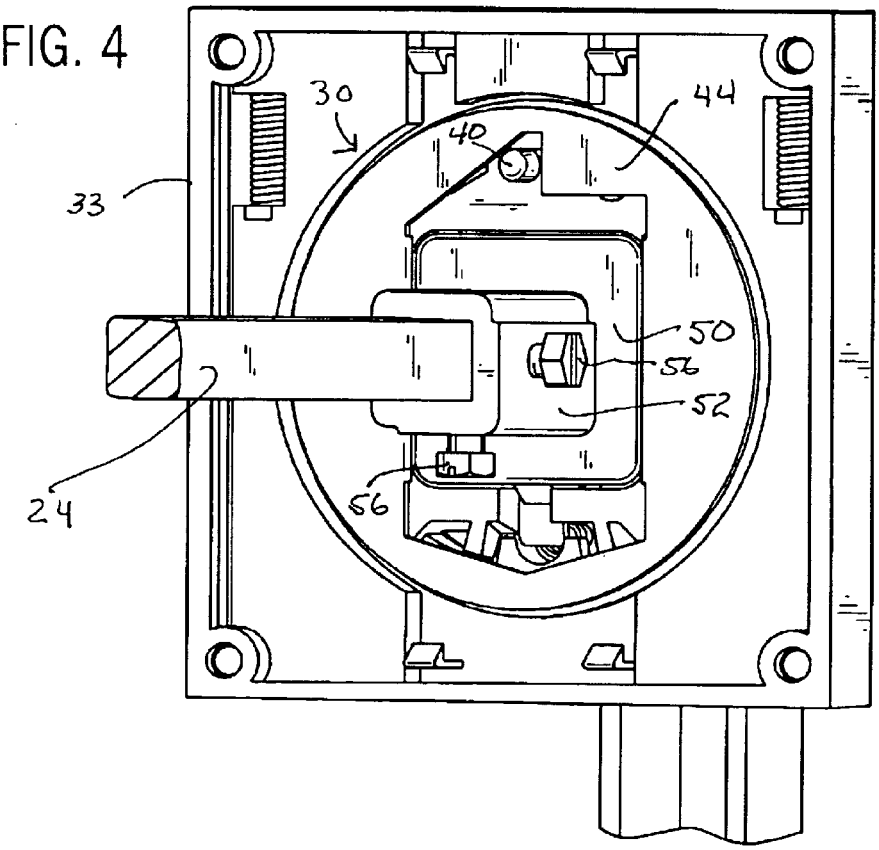
FIG. 4 is a perspective back side view of the extended rotary handle mechanism illustrated in FIG. 2.
Figures 7, 7A:
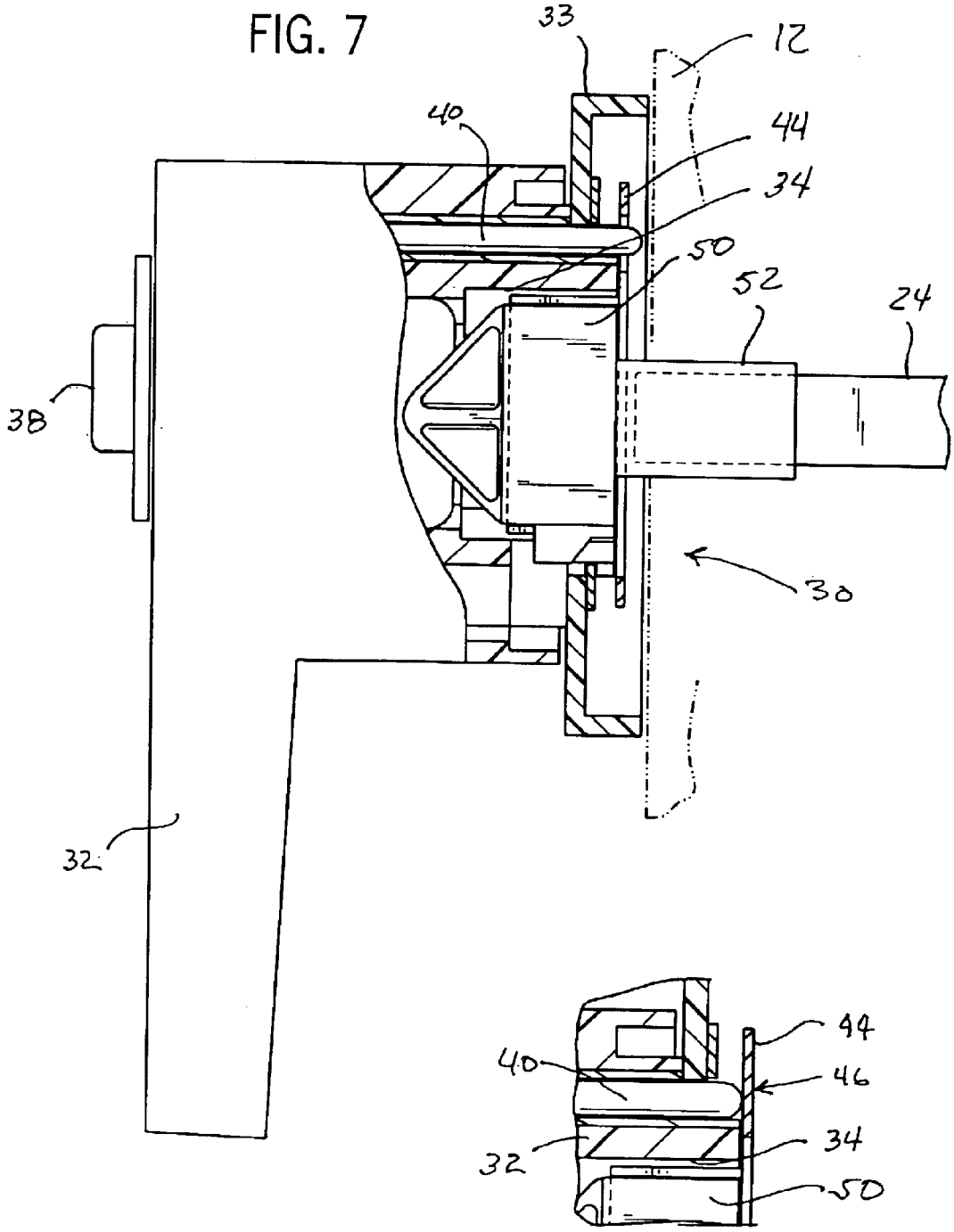
FIG. 7 is a partial sectional side view of an extended rotary handle mechanism illustrated in FIG. 5 along the line 7—7 with a shaft adapter including an extended socket for the shaft.
FIG. 7*a* is a partial sectional side view of a locking pin blocked by a blocking plate of an extended rotary handle mechanism.
Figure 8:
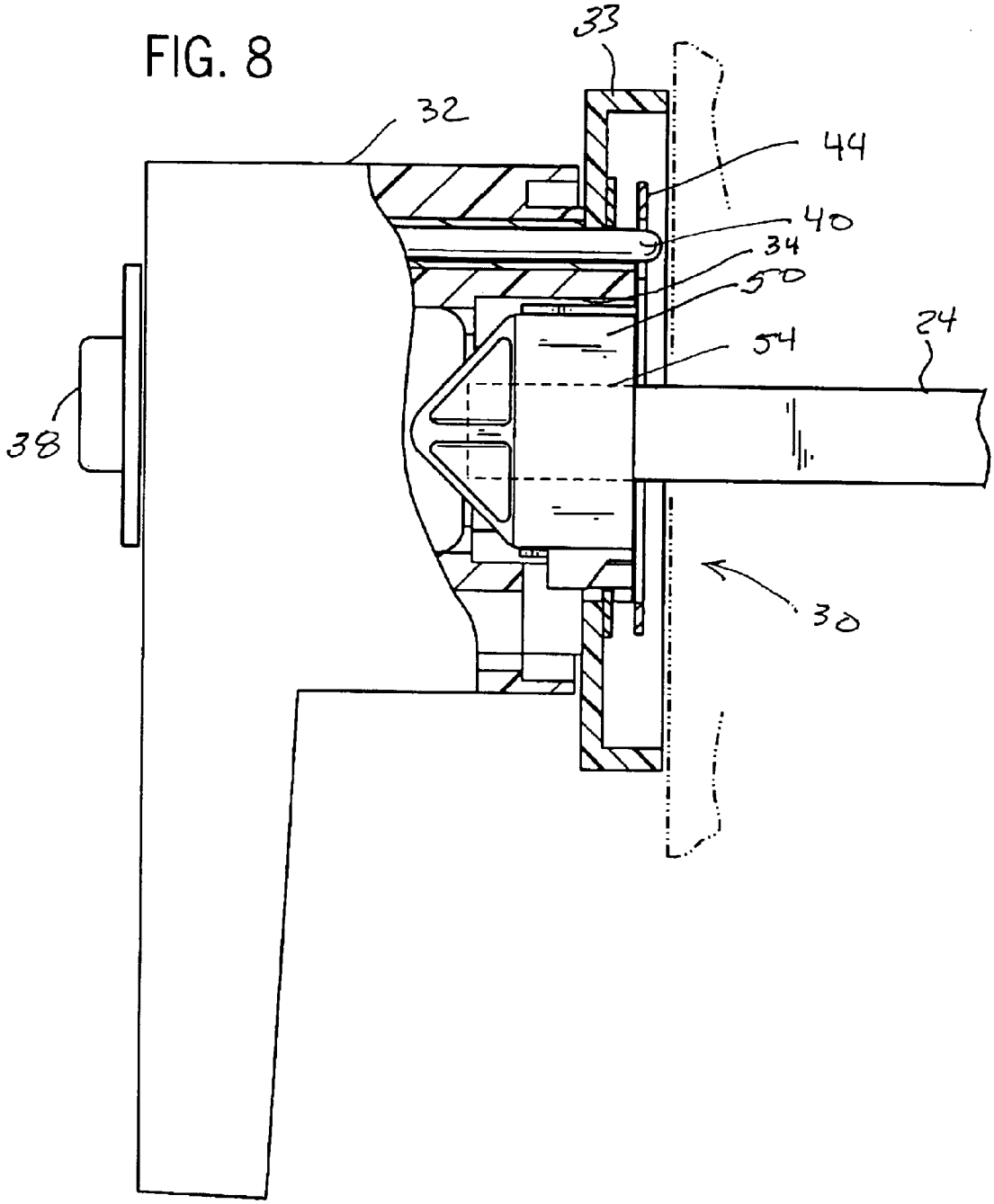
FIG. 8 is a partial sectional view of an exemplary embodiment of an extended rotary handle mechanism, with a shaft adapter defining a recessed socket for the shaft.

A shaft adapter 50 (see FIGS. 3, 4, 7 and 8) couples to the blocking plate 44 by insertion of the shaft adapter 50 into the socket 34. The shaft adapter 50 is also coupled to the shaft 24. One embodiment of the shaft adapter (see FIG. 7) includes an extended socket 52 which is configured to engage the shaft 24. Another embodiment of the shaft adapter 50 includes a recessed socket 54 which is also configured to engage the shaft 24. The fasteners 56 can be used to secure the shaft 24 in either the extended socket 52 or the recessed socket 54. FIG. 4 illustrates fasteners securing the shaft 24 into the extended socket 52 of the shaft adapter 50. The shaft adapter 50 can be composed of metal. The shaft adapter 50 fits in the socket 34 of the handle operator 32 tight to the blocking plate 44 but loose in the handle operator 32.

In operation, when the handle operator 32 is rotated, in other words, when torque is applied to the handle operator 32, if the electrical contacts 26 of the circuit breaker 20 are closed, for example, welded closed, the blocking shape 46 of the blocking plate 44 prevents the handle operator 32 from being locked in an "OFF" position, independently of the circuit breaker operating handle 22 position by covering a locking hole 36. (see FIGS. 5 and 6) The locking pin 40 is mounted in the handle operator 32 and coupled to a lock actuator 38 which is mounted on the handle operator 32. Moving the lock actuator 32 moves the locking pin 40 past the blocking plate 44 into the locking hole 40 if the electrical contacts 26 of the circuit breaker 20 are open. (see FIGS. 5, 7 and 8) If the electrical contacts 26 of the circuit breaker 20 are closed and an operator attempts to lock the handle operator 32 of the extended rotary operating mechanism 30, the torque applied to the handle operator 32 will rotate the handle operator 32 approximately 6° thereby closing the gaps 41 between the blocking plate 44 and the socket 34 (see FIG. 6) and moving the blocking shape 46 to a position blocking the locking hole 36, thereby preventing the locking pin 40 from locking the handle operator 32 in an "OFF" position (see FIGS. 6 and 7*a*).

The handle actuator 32 can be coupled to a mechanized, remotely controlled actuator or it can be operated manually. The actuator can be an electric motor or a hydraulic or pneumatic cylinder.

In a typical configuration, the shaft adapter 50 is coupled to the shaft 24 and will decouple from the handle operator 32, socket 34 and blocking plate 44 when the cabinet door 12 is opened. When the cabinet door 12 is moved to a closed position, the shaft adapter 50 reengages the handle operator 32 and inserts through the blocking plate 44 into the socket 34. The cabinet door 12 can only open when the circuit breaker 20 is in the "OFF" position.

The method for preventing an operating handle 22 of the circuit breaker 20 from being locked in an "OFF" position when electrical contacts 22 of the circuit breaker 20 are welded closed will now be described. The circuit breaker 20 has a shaft 24 coupled to the operating handle 22 of the circuit breaker 20. The method comprises the steps of providing a handle operator 32 having a socket 34 and a mounting plate 33 defining a locking hole 36 and providing a blocking plate 24 having a blocking shape 46 configured to fit in the socket 34. A shaft adapter 50 is coupled to the blocking plate 44 and the shaft 24. Covering the locking hole 36 with the blocking shape 46 when a torque is applied to the handle operator 32 prevents the operating handle 22 of the circuit breaker 20 from being locked in an "OFF" position since the locking pin 40 cannot engage the locking hole 36. The handle operator 32 can be operated manually or by remotely controlled actuator, such as for example an electric motor, a pneumatic or hydraulic cylinder.

Thus, there is provided an apparatus and method for an extended rotary operating mechanism that will prevent the operating handle 22 of the circuit breaker 20 from being locked in an "OFF" position when the electrical contacts of the circuit breaker are closed. While the embodiments illustrated in the figures and described above are presently preferred, it should be understood that these embodiments are offered by way of example only. The invention is not intended to be limited to any particular embodiment but is intended to extend to various modifications that nevertheless fall within the scope of the appended claims, although modifications will be evident to those with ordinary skill in the art.

What is claimed is:

1. An extended rotary operating mechanism for a circuit breaker having a movable operating handle coupled to a shaft and electrical contacts, the extended rotary operating mechanism comprising:

a handle operator defining a socket;

a blocking plate mounted in the socket, the blocking plate including a blocking shape; and a shaft adaptor coupled to the blocking plate and the shaft, wherein if the electrical contacts are welded closed and a torque is applied to the handle operator, the blocking shape prevents the handle operator from being locked in an "OFF" position, independently of an operating handle position, by covering a locking hole.

2. The extended rotary operating mechanism of claim 1, wherein the socket is configured to allow the handle operator at least 3° up to 8° of rotary motion before the blocking plate is moved into a blocking position.

3. The extended rotary operating mechanism of claim 1, wherein the handle operator is operated manually.

4. The extended rotary operating mechanism of claim 1, including a locking pin configured to engage the locking hole to lock the handle operator in the "OFF" position.

5. The extended rotary operating mechanism of claim 1, wherein the blocking plate and the shaft adaptor rotate together as the handle operator is moved.

6. The extended rotary operating mechanism of claim 1, wherein the shaft adaptor is coupled to the shaft with fasteners.

7. The extended rotary operating mechanism of claim 1, wherein the blocking plate and the shaft adaptor are composed of metal.

8. The extended rotary operating mechanism of claim 1, wherein the shaft adapter includes one of an extended socket and a recessed socket configured to engage the shaft.

9. A method for preventing an operating handle of a circuit breaker from being locked in an "OFF" position when electrical contacts of the circuit breaker are welded closed, with the circuit breaker having a shaft coupled to the operating handle, the method comprising the steps of:

providing a handle operator having a socket and a mounting plate defining a locking hole;

providing a blocking plate having a blocking shape and configured to fit in the socket;

providing a shaft adaptor;

coupling the shaft adaptor to the blocking plate and the shaft; and covering the locking hole with the blocking shape when a torque is applied to the handle operator.

10. The method for preventing an operating handle of a circuit breaker from being locked of claim 9, including the step of rotating the handle operator up to 6° before the blocking plate is moved to block the locking hole.

11. The method for preventing an operating handle of a circuit breaker from being locked of claim 9, including the step of operating the handle operator manually.

12. The method for preventing an operating handle of a circuit breaker from being locked of claim 9, wherein the shaft adapter includes one of an extended socket and a recessed socket configured to engage the shaft.

13. The method for preventing an operating handle of a circuit breaker from being locked of claim 12, including the steps of providing fasteners to secure the shaft adaptor to the shaft and securing the shaft to the shaft adaptor.

14. An extended rotary operating mechanism for a circuit breaker having a movable operating handle coupled to a shaft, and electrical contacts, the extended rotary operating mechanism comprising:

a means for rotating defining a socket;

a means for blocking mounted in the socket; and a means for coupling operatively connected to the means for blocking and the shaft, wherein if the electrical contacts are welded closed and a torque is applied to the means for rotating, the means for blocking prevents the means for rotating from being locked in an "OFF" position, independently of an operating handle position, by covering a locking hole.

15. The extended rotary operating mechanism of claim 14, wherein the socket is configured to allow the means for rotating at least 3° up to 8° of rotary motion before the means for blocking is moved into a blocking position.

16. The extended rotary operating mechanism of claim 14, wherein the means for rotating is operated manually.

17. The extended rotary operating mechanism of claim 14, including a locking pin configured to engage the locking hole to lock the means for rotating in the "OFF" position.

18. The extended rotary operating mechanism of claim 14, wherein the means for blocking and the means for coupling rotate together as the means for rotating is moved.

19. The extended rotary operating mechanism of claim 14, wherein the means for coupling is operatively connected to the shaft with fasteners.

20. The extended rotary operating mechanism of claim 14, wherein the means for blocking and the means for coupling are composed of metal.

* * * * *